US008253510B2

(12) United States Patent
Wada

(10) Patent No.: US 8,253,510 B2
(45) Date of Patent: Aug. 28, 2012

(54) NON-RECIPROCAL CIRCUIT ELEMENT

(75) Inventor: Takaya Wada, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/024,349

(22) Filed: Feb. 10, 2011

(65) Prior Publication Data

US 2011/0204989 A1 Aug. 25, 2011

(30) Foreign Application Priority Data

Feb. 25, 2010 (JP) ..... 2010-039864

(51) Int. Cl.
*H01P 1/36* (2006.01)

(52) U.S. Cl. ..... 333/24.2

(58) Field of Classification Search ..... 333/1.1, 333/24.2

See application file for complete search history.

(56) References Cited

U.S. PATENT DOCUMENTS

| | | | |
|---|---|---|---|
| 2006/0028286 | A1 | 2/2006 | Kishimoto et al. |
| 2007/0030089 | A1 | 2/2007 | Hino |
| 2009/0058551 | A1 | 3/2009 | Wada et al. |

FOREIGN PATENT DOCUMENTS

| | | | |
|---|---|---|---|
| JP | 07-283615 | A | 10/1995 |
| JP | 9-93004 | A | 4/1997 |
| JP | 2007-306149 | A | 11/2007 |
| JP | 4155342 | B1 | 9/2008 |
| JP | 4197032 | B2 | 12/2008 |
| JP | 2009-302742 | A | 12/2009 |
| KR | 10-2006-0049933 | A | 5/2006 |
| WO | 2009/028112 | A1 | 3/2009 |

OTHER PUBLICATIONS

Official Communication issued in corresponding Japanese Patent Application No. 2010-039864, mailed on May 29, 2012.

*Primary Examiner* — Stephen Jones
(74) *Attorney, Agent, or Firm* — Keating & Bennett, LLP

(57) ABSTRACT

A non-reciprocal circuit element includes first and second isolators of a high-pass type, each of the first and second isolators including a permanent magnet, a ferrite body to which a direct-current magnetic field is applied by the permanent magnet, and first and second center electrodes arranged on the ferrite body so as to cross each other in an insulated state. The first isolator has a passing frequency band that is higher than a passing frequency band of the second isolator. The first and second isolators include input portions that are electrically connected to define a single input port. A low pass filter is provided between the input port and the input portion of the second isolator.

6 Claims, 14 Drawing Sheets

NON-RECIPROCAL CIRCUIT ELEMENT

BACKGROUND OF THE INVENTION

1. Field of the Invention

The present invention relates to non-reciprocal circuit elements, and more particularly, to a non-reciprocal circuit element, such as an isolator or a circulator, used in a microwave band.

2. Description of the Related Art

Non-reciprocal circuit elements, such as isolators and circulators, have characteristics of transmitting signals only in a certain predetermined direction and not in the opposite direction. These characteristics of isolators, for example, are used in transmitter circuits of mobile communication devices, such as automobile phones and mobile phones.

Japanese Patents Nos. 4155342 and 4197032 describe two-port isolators used as non-reciprocal circuit elements of the above-described type. The two-port isolators have the basic structure in which a first center electrode and a second center electrode are arranged on a surface of a ferrite body so as to cross each other in an insulated state. A resistor is connected between an end of the first center electrode that is connected to an input port and an end of a second center electrode that is connected to an output port. The resistor is connected in series with an inductor. In each of the two-port isolators, insertion loss is reduced and isolation characteristics are improved.

Recently, it has become possible for a single mobile phone to provide communication in a plurality of frequency bands. To achieve this, according to the related art, one isolator is used for each frequency band. However, in this case, the number of components is increased. Therefore, there is a demand for non-reciprocal circuit elements that can be used in a plurality of frequency bands. In other words, there is a demand for non-reciprocal circuit elements having a single input port and at least two output ports which can be used in a plurality of frequency bands.

To achieve operations in a plurality of frequency bands, the inventors of the present invention have devised a non-reciprocal circuit element in which a pair of two-port isolators similar to those described in Japanese Patents Nos. 4155342 and 4197032 are combined. The two-port isolators are of the high-pass type. Referring to FIG. 14, if the isolators are combined so as to operate in frequency bands f1 and f2, a harmonic frequency band of the frequency band f2 overlaps the frequency band f1. This causes a communication failure.

Japanese Unexamined Patent Application Publication No. 9-93004 describes a three-port isolator with an increased operation frequency band. According to this publication, a non-reciprocal circuit element includes first and second non-reciprocal circuits that operate at first and second frequencies, respectively, and first and second phase converter circuits that are connected to input and output ports of the first and second non-reciprocal circuits, respectively, and that are substantially opened at the second and first frequencies, respectively. The first and second phase converter circuits and the first and second non-reciprocal circuits are connected in parallel to form a single circuit element unit.

The three-port isolator described in Japanese Unexamined Patent Application Publication No. 9-93004 is basically of a low-pass type, and there is no risk of interference between the first and second frequencies since the second phase converter circuit is provided. However, when four phase converter circuits are provided to increase the operation frequency band, the insertion loss increases. In addition, the number of components also increases, which makes it difficult to achieve reduction in size.

SUMMARY OF THE INVENTION

Preferred embodiments of the present invention provide a non-reciprocal circuit element capable of operating in a plurality of frequency bands and preventing increases in the number of components and insertion loss.

According to a preferred embodiment of the present invention, a non-reciprocal circuit element includes first and second isolators of a high-pass type, each of the first and second isolators including a permanent magnet, a ferrite body to which a direct-current magnetic field is applied by the permanent magnet, and first and second center electrodes arranged on the ferrite body so as to cross each other in an insulated state. The first isolator has a passing frequency band that is higher than a passing frequency band of the second isolator. The first and second isolators include input portions that are electrically connected to define a single input port. A low pass filter is provided between the input port and the input portion of the second isolator.

In the non-reciprocal circuit element according to a preferred embodiment of the present invention, the input portions of the first and second isolators are electrically connected to define a single input port. Therefore, the non-reciprocal circuit element functions as a single non-reciprocal circuit element. In addition, a low pass filter is provided between the input port and the input portion of the second isolator. Therefore, the harmonic frequency band is attenuated in the second isolator having a low passing frequency band. As a result, interference with the first isolator having a high passing frequency band can be prevented. The low pass filter is disposed at a single position between the input port and the input portion of the second isolator. Therefore, increases in the insertion loss and the number of components can be prevented.

According to a preferred embodiment of the present invention, operations can be performed in a plurality of frequency bands and increases in the number of components and insertion loss can be prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Non-reciprocal circuit elements according to preferred embodiments of the present invention will now be described with reference to the accompanying drawings. In the preferred embodiments, similar components or portions are denoted by the same reference symbols, and redundant explanations will be omitted.

First Preferred Embodiment

FIGS. 1 to 8

Figure 1:
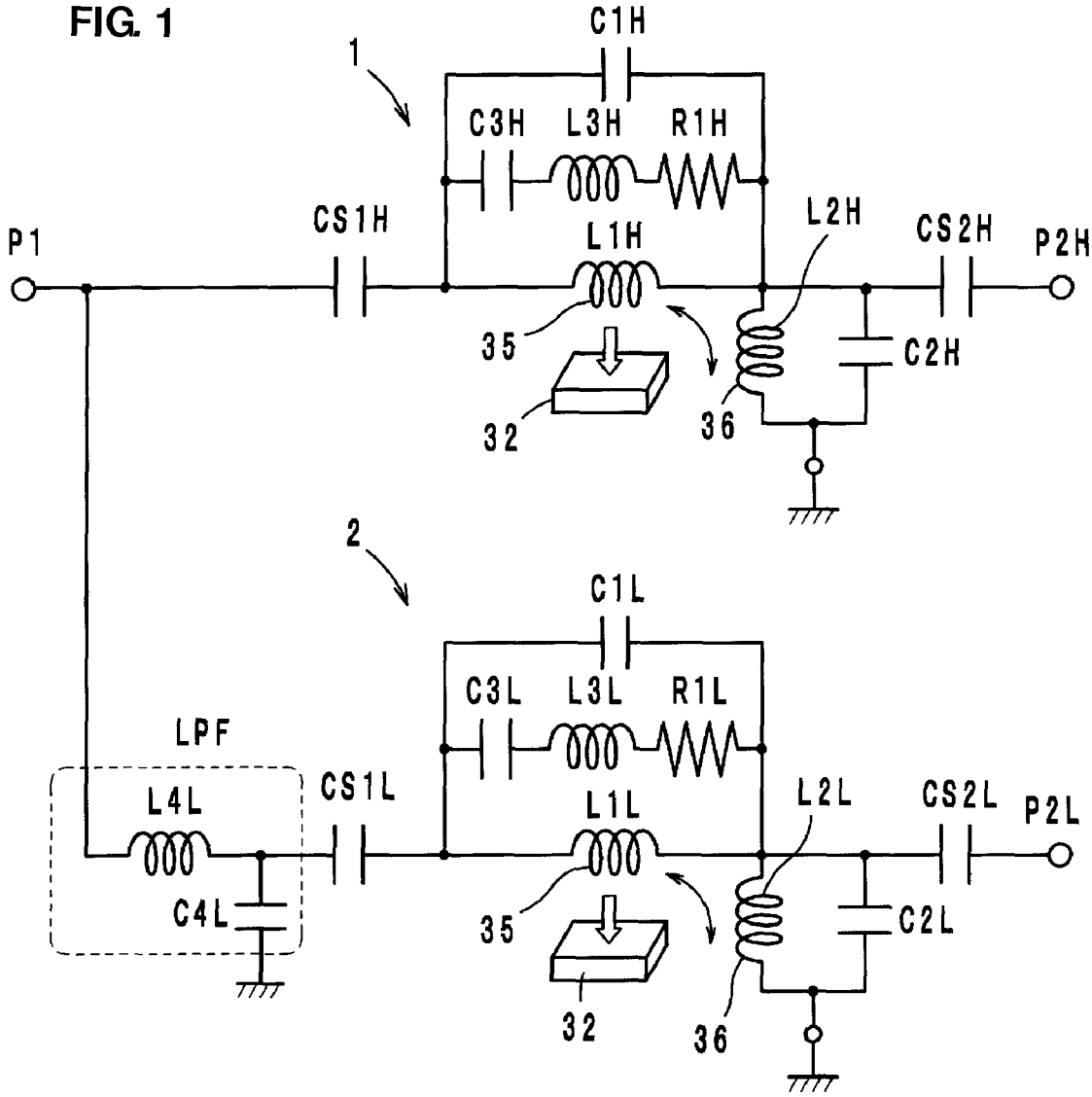
FIG. 1 is an equivalent circuit diagram illustrating a non-reciprocal circuit element according to a first preferred embodiment of the present invention.

FIG. 1 illustrates an equivalent circuit of a non-reciprocal circuit element according to the first preferred embodiment of the present invention. Referring to FIG. 1, the non-reciprocal circuit element includes a first two-port isolator 1 and a second two-port isolator 2 that are integrated as a unit. The first and second isolators 1 and 2 preferably are lumped constant isolators, and are preferably configured such that first center electrodes 35 that define inductors L1H and L1L and second center electrodes 36 that define inductors L2H and L2L are arranged on ferrite bodies 32 so as to cross each other in an insulated state.

A passing frequency band f1 of the first isolator 1 is preferably set to be higher than a passing frequency band f2 of the second isolator 2. Input portions of the first and second isolators 1 and 2 are connected to each other as a single input port P1, and output portions thereof serve as output ports P2H and P2L. A low pass filter LPF is provided between the input port P1 and the input portion of the second isolator 2.

The circuit structure of the first and second isolators 1 and 2 will now be explained. Here, "H" is attached to the reference symbols of circuit components of the first isolator 1, and "L" is attached to the reference symbols of circuit components of the second isolator 2. Although the first isolator 1 will be described below, the second isolator 2 has a structure similar to that of first isolator 1.

An end of the first center electrode 35 is connected to the input port P1 with a matching capacitor CS1H provided therebetween. The other end of the first center electrode 35 and an end of the second center electrode 36 are connected to the output port P2H with a matching capacitor CS2H provided therebetween. The other end of the second center electrode 36 is connected to the ground.

A matching capacitor C1H is connected between the input port P1 and the output port P2H in parallel with the first center electrode 35. A matching capacitor C2H is connected between the output port P2H and the ground in parallel with the second center electrode 36. A resistor R1H and an LC series resonant circuit (including an inductor L3H and a capacitor C3H) are connected between the input port P1 and the output port P2H in parallel with the first center electrode 35.

In the two-port isolator 1 having the above-described circuit structure, when a high-frequency current is input to the input port P1, a large high-frequency current flows through the second center electrode 36, while the high-frequency current hardly flows through the first center electrode 35. Therefore, insertion loss is low and an operation can be performed over a wide frequency band. During the operation, the high-frequency current hardly flows through the resistor R1H or the LC series resonant circuit (the inductor L3H and the capacitor C3H). Therefore, loss caused by the LC series resonant circuit can be ignored and the insertion loss does not increase. When the high-frequency current is input to the output port P2H, matching is provided over a wide frequency band by the impedance characteristics of the resistor R1H and the LC series resonant circuit. Thus, the isolation characteristics are improved.

Figure 5:
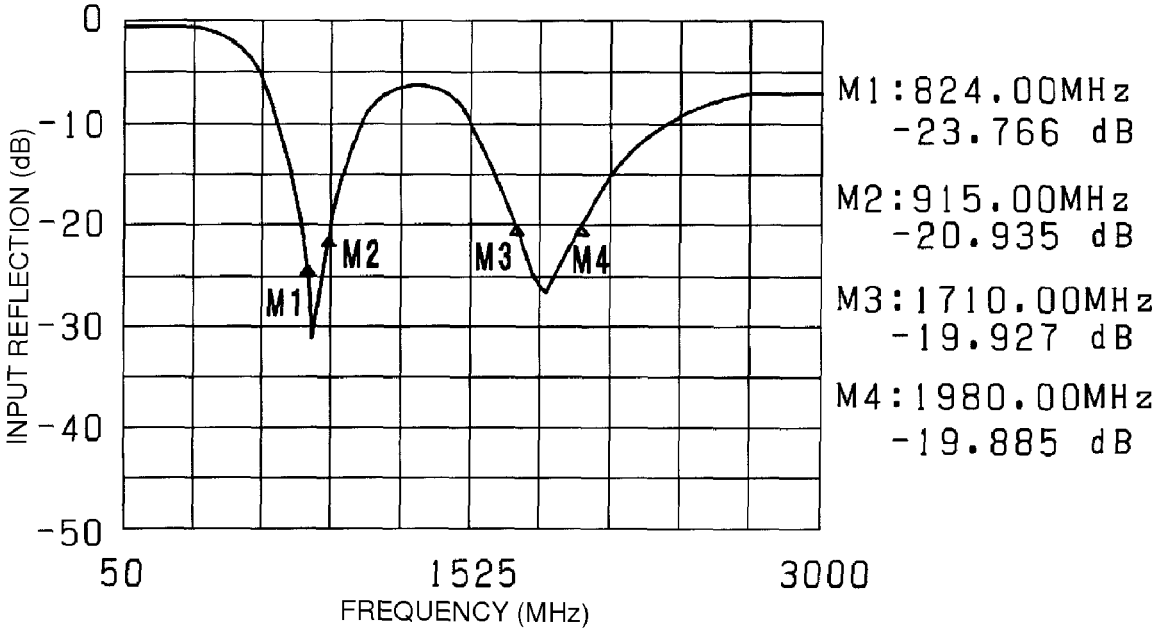
FIG. 5 is a graph showing the input reflection characteristics of the non-reciprocal circuit element according to the first preferred embodiment of the present invention.
Figure 6:
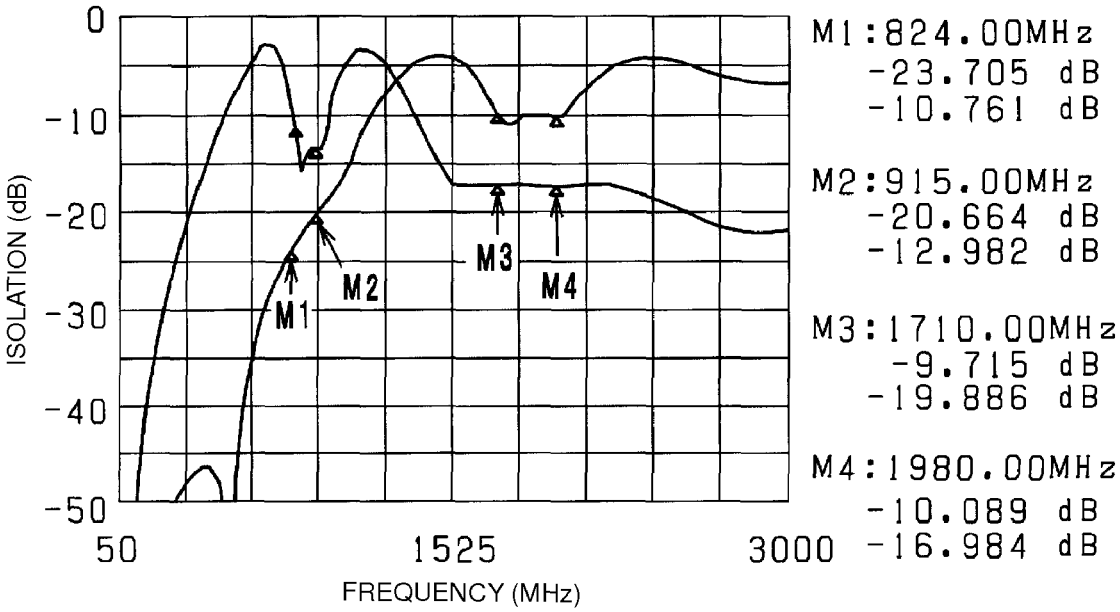
FIG. 6 is a graph showing the isolation characteristics of the non-reciprocal circuit element according to the first preferred embodiment of the present invention.
Figure 7:
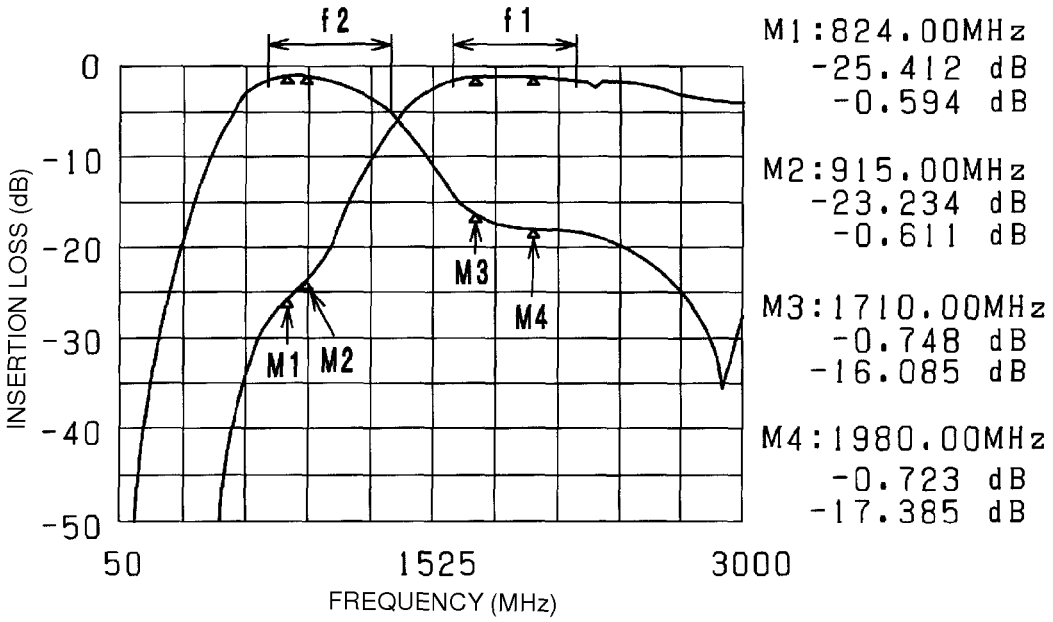
FIG. 7 is a graph showing the insertion loss characteristics of the non-reciprocal circuit element according to the first preferred embodiment of the present invention.
Figure 8:
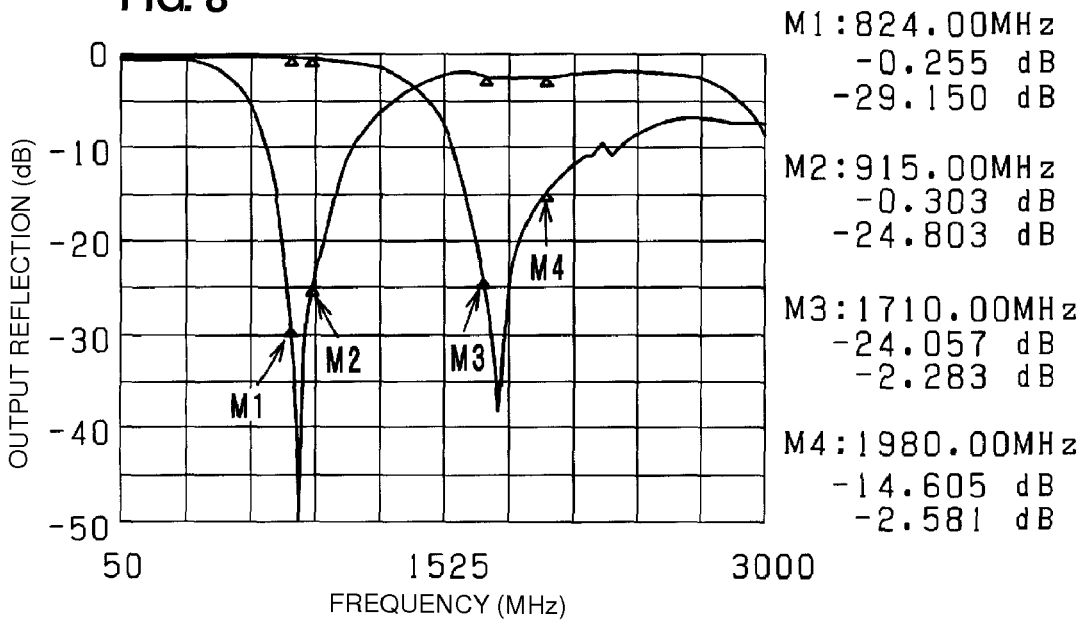
FIG. 8 is a graph showing the output reflection characteristics of the non-reciprocal circuit element according to the first preferred embodiment of the present invention.

In the first preferred embodiment, the low pass filter LPF is provided between the input port P1 and the input portion of the second isolator 2. The low pass filter LPF preferably includes an L-type resonant circuit including an inductor L4L and a capacitor C4L. FIG. 7 shows the insertion loss characteristics obtained by the first preferred embodiment in which the low pass filter LPF is provided. The passing frequency band f2 of the second isolator 2 is preferably set to be lower than the passing frequency band f1 of the first isolator 1. Owing to the low pass filter LPF, in the second isolator 2, the band corresponding to the passing frequency band f1 is largely attenuated. FIGS. 5, 6, and 8 show the input reflection characteristics, the isolation characteristics, and the output reflection characteristics, respectively, obtained by the first preferred embodiment.

The band corresponding to the frequency band f1 as seen from the frequency band f2 is attenuated so that the output port P2H serves as a substantially open end. Accordingly, even though the input portions of the first and second isolators 1 and 2 are combined together, the electrical characteristics are not largely degraded. In addition, with regard to the band corresponding to the frequency band f2 as seen from the passing frequency band f1, since the second isolator 2 is of the high-pass type, the output port P2L serves as a substantially open end. Therefore, the first and second isolators 1 and 2 can be combined together without causing degradations.

As described above, in the first preferred embodiment, the input portions of the first and second isolators 1 and 2 are electrically connected to each other to define a single input port P1, and a single non-reciprocal circuit element is provided as a unit. In addition, since the low pass filter LPF is provided between the input port P1 and the input portion of the second isolator 2, the harmonic frequency band is attenuated in the second isolator 2 having a low passing frequency band f2. Therefore, interference with the first isolator 1 having a high passing frequency band f1 can be prevented. The low pass filter LPF is disposed at a single position between the input port P1 and the input portion of the second isolator 2. Therefore, increases in the insertion loss and the number of components can be prevented.

Figure 2:
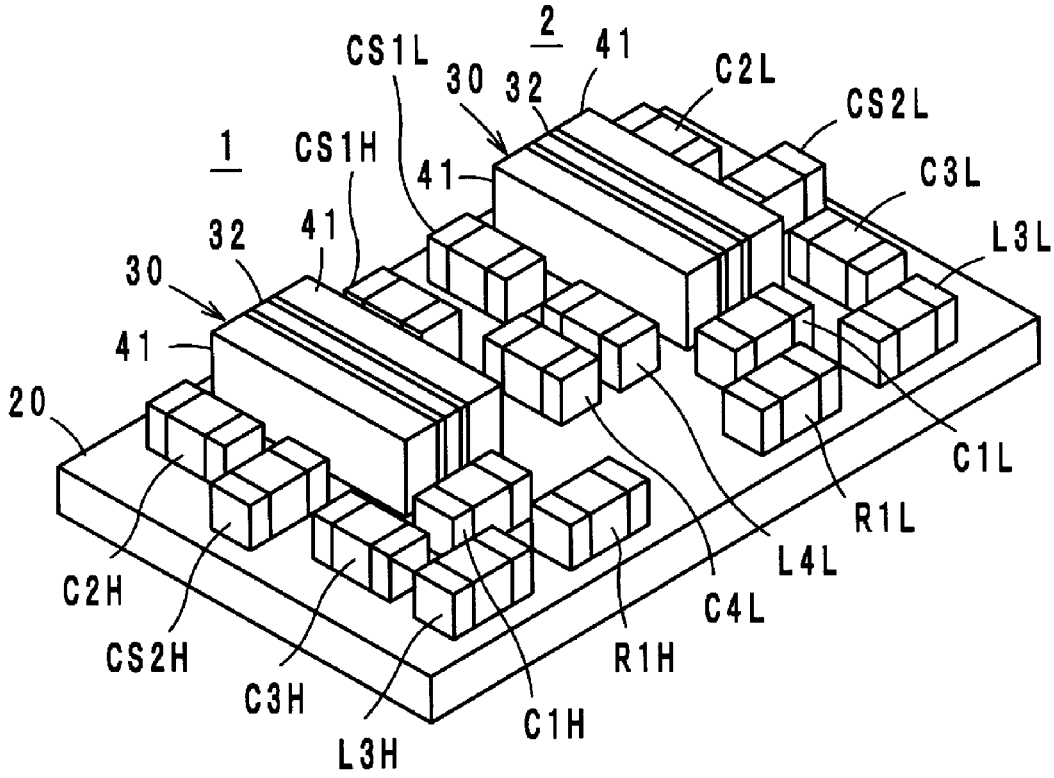
FIG. 2 is a perspective view of the non-reciprocal circuit element according to the first preferred embodiment of the present invention.

Next, the structure of the first and second isolators 1 and 2 will be described with reference to FIGS. 2 to 4. As illustrated in FIG. 2, the isolators 1 and 2 are mounted on a circuit board 20, and each isolator includes a ferrite-magnet element 30 including a ferrite body 32 and permanent magnets 41 and chip-type elements.

Figure 3:
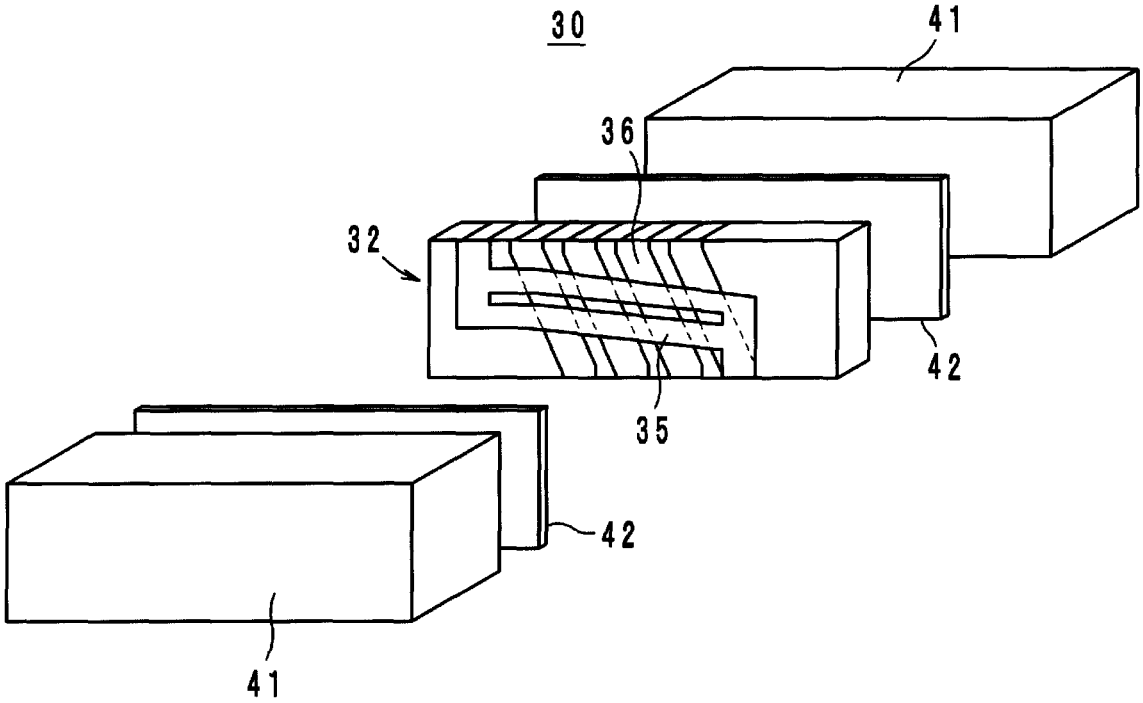
FIG. 3 is an exploded perspective view of a ferrite-magnet element.
Figure 4:
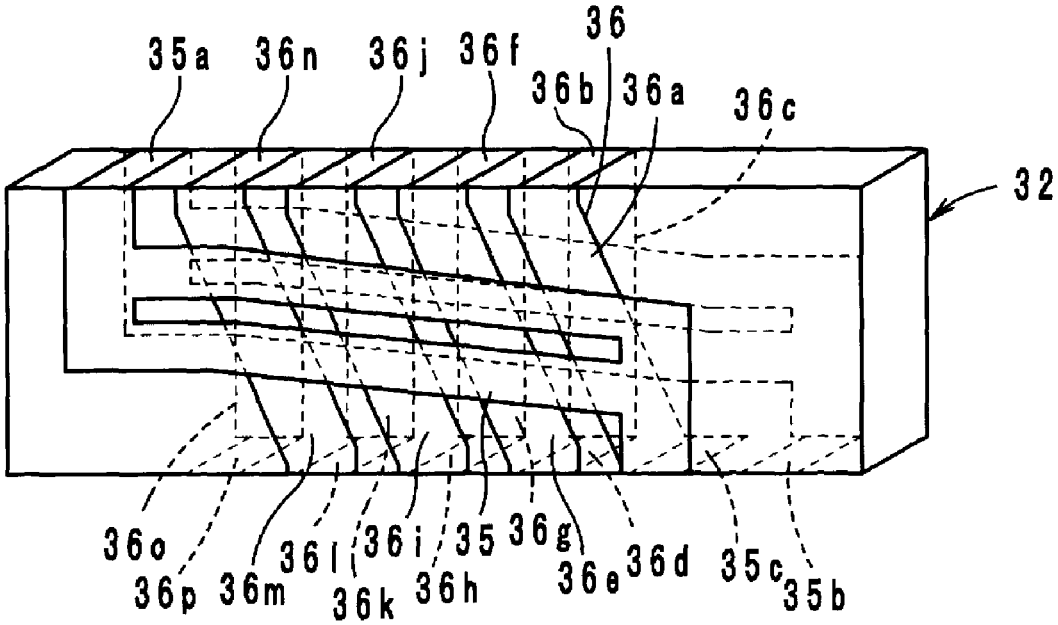
FIG. 4 is a perspective view of a ferrite body provided with center electrodes.

Referring to FIGS. 3 and 4, the first and second center electrodes 35 and 36 are wound around each ferrite body 32 such that the first and second center electrodes 35 and 36 are electrically insulated from each other. The permanent magnet 41 are bonded to the ferrite body 32 with, for example, epoxy adhesive members 42 such that a direct-current magnetic field is applied to the ferrite body 32 in a thickness direction.

The first center electrode 35 is preferably made of a conductive film. More specifically, as illustrated in FIG. 4, the first center electrode 35 extends upward from a lower right position on the front surface of the ferrite body 32, extends toward the upper left at a relatively small angle with respect to the longitudinal sides of the ferrite body 32 while branching into two sections, and then extends upward to an upper left position. The first center electrode 35 further extends to the back surface of the ferrite body 32 with an intermediate electrode 35*a* provided on the top surface of the ferrite body 32. The first center electrode 35 extends along the back surface such that the first center electrode 35 branches into two sections so as to overlap the first center electrode 35 on the front surface in a perspective view. One end of the first center electrode 35 is connected to a connection electrode 35*b* provided at the bottom surface of the ferrite body 32. The other end of the first center electrode 35 is connected to a connection electrode 35*c* that is also provided on the bottom surface of the ferrite body 32. Thus, the first center electrode 35 is wound one turn around the ferrite body 32. An insulator film is provided between the first center electrode 35 and the second center electrode 36, which will be described below, so that the first and second center electrodes 35 and 36 cross each other in an insulated state.

The second center electrode 36 is formed of a conductive film. A 0.5th-turn segment 36*a* of the second center electrode 36 extends from a lower right position toward the upper left on the front surface of the ferrite body 32 at a relatively large angle with respect to the longitudinal sides of the ferrite body 32 so as to cross the first center electrode 35. The second center electrode 36 extends to the back surface of the ferrite body 32 with an intermediate electrode 36*b* provided on the top surface of the ferrite body 32, and a 1st-turn segment 36*c* of the second center electrode 36 substantially perpendicularly crosses the first center electrode 35 on the back surface of the ferrite body 32. The bottom portion of the 1st-turn segment 36*c* extends to the front surface with an intermediate electrode 36*d* provided on the bottom surface of the ferrite body 32, and a 1.5th-turn segment 36*e* of the second center electrode 36 crosses the first center electrode 35 on the front surface of the ferrite body 32 and extends to the back surface thereof with an intermediate electrode 36*f* provided on the top surface. Similarly, a 2nd-turn segment 36*g*, an intermediate electrode 36*h*, a 2.5th-turn segment 36*i*, an intermediate electrode 36*j*, a 3rd-turn segment 36*k*, an intermediate electrode 36*l*, a 3.5th-turn segment 36*m*, an intermediate electrode 36*n*, and a 4th-turn segment 36*o* are formed on front, back, top, and bottom surfaces of the ferrite body 32. The ends of the second center electrode 36 are connected to the connection electrode 35*c* and a connection electrode 36*p* provided on the bottom surface of the ferrite body 32. The connection electrode 35*c* is used as a common connection electrode for the ends of the first and second center electrodes 35 and 36.

Thus, the second center electrode 36 is helically wound four turns, for example, around the ferrite body 32. The number of turns is counted such that the second center electrode 36 is wound 0.5 turns when the second center electrode 36 extends along the front or back surface once. The crossing angles between the center electrodes 35 and 36 are set as necessary so as to adjust the input impedance and insertion loss.

The above-described components are connected to the circuit illustrated in FIG. 1 with wiring (not shown) on the circuit board 20.

Second Preferred Embodiment

FIG. 9

Figure 9:
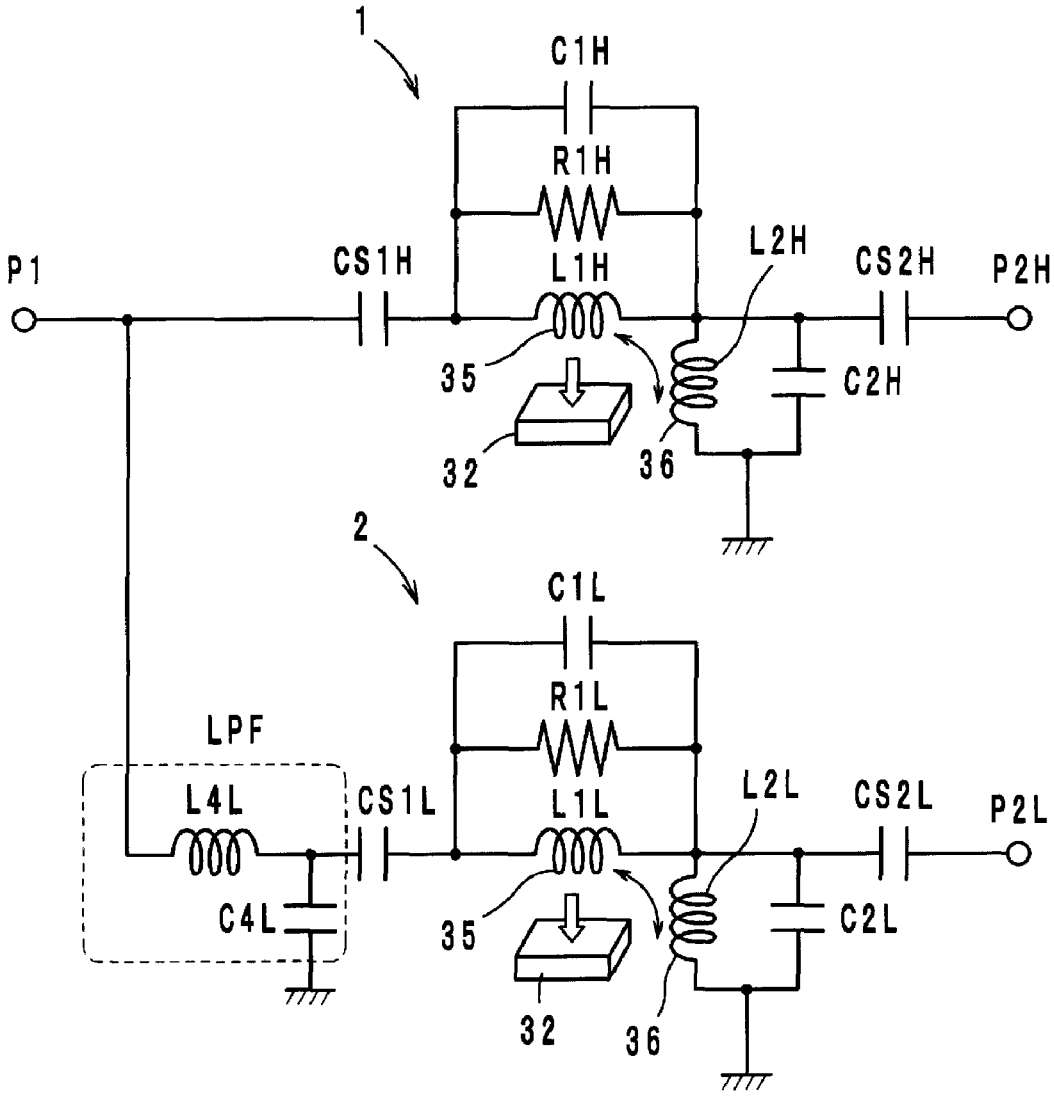
FIG. 9 is an equivalent circuit diagram illustrating a non-reciprocal circuit element according to a second preferred embodiment of the present invention.

Referring to FIG. 9, a non-reciprocal circuit element according to a second preferred embodiment basically has a circuit structure similar to that of the first preferred embodiment, except the LC series resonant circuit (inductors L3H and L3L and capacitors C3H and C3L) is removed from the equivalent circuit illustrated in FIG. 1. The L-type low pass filter LPF is provided between the input port P1 and the input portion of the second isolator 2, and provides an operational effect similar to that in the first preferred embodiment.

Third Preferred Embodiment

FIG. 10

Figure 10:
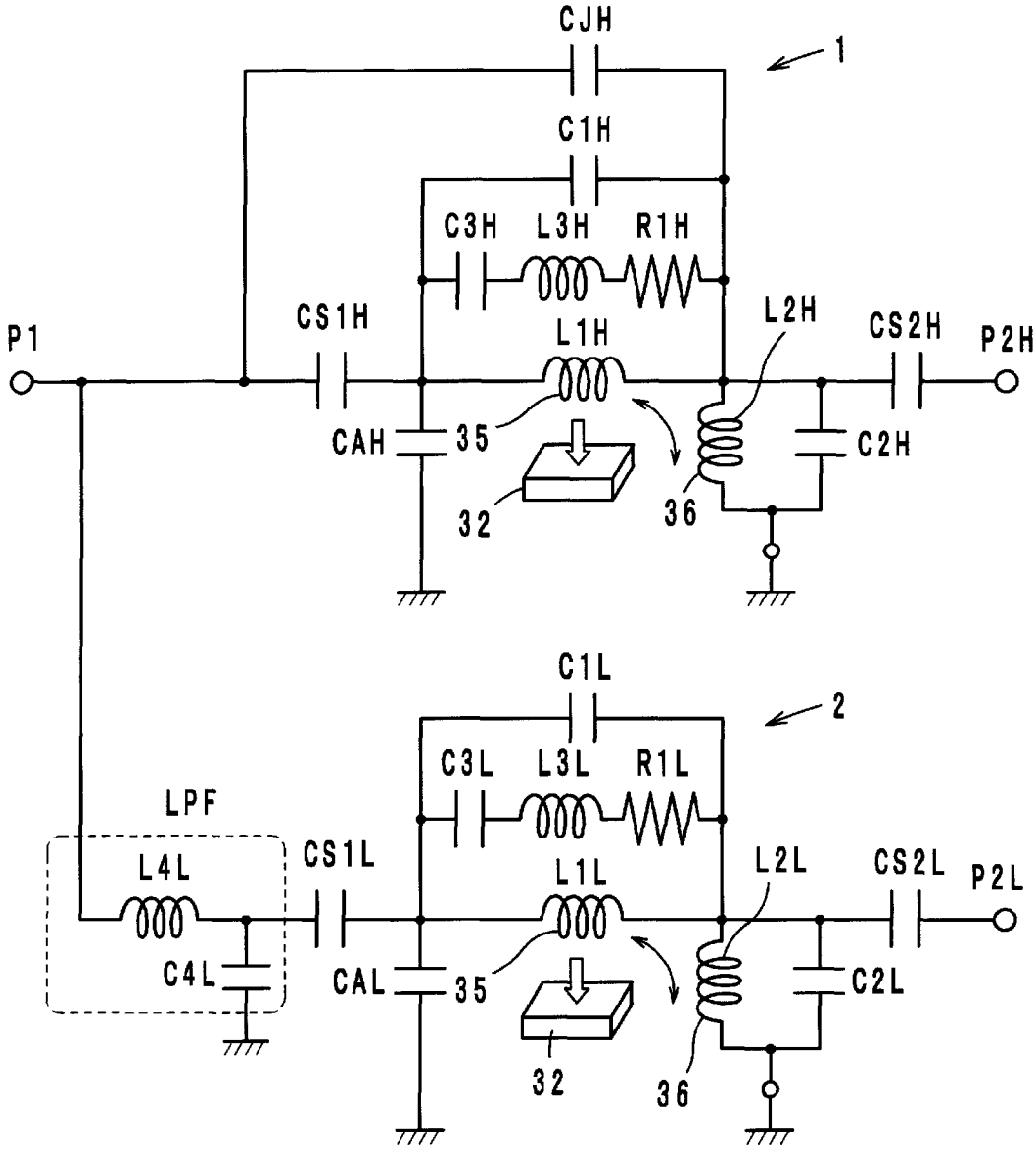
FIG. 10 is an equivalent circuit diagram illustrating a non-reciprocal circuit element according to a third preferred embodiment of the present invention.

Referring to FIG. 10, a non-reciprocal circuit element according to a third preferred embodiment basically has a circuit structure similar to that of the first preferred embodiment, except impedance adjusting capacitors CAH and CAL and a capacitor CJH are additionally provided. The impedance adjusting capacitors CAH and CAL are connected between the ground and the ends of the first center electrodes 35. The capacitor CJH is provided between the input portion and the output portion of the first isolator 1 to adjust the insertion loss and isolation. The L-type low pass filter LPF is provided between the input port P1 and the input portion of the second isolator 2, and provides an operational effect similar to that in the first preferred embodiment.

Fourth Preferred Embodiment

FIG. 11

Figure 11:
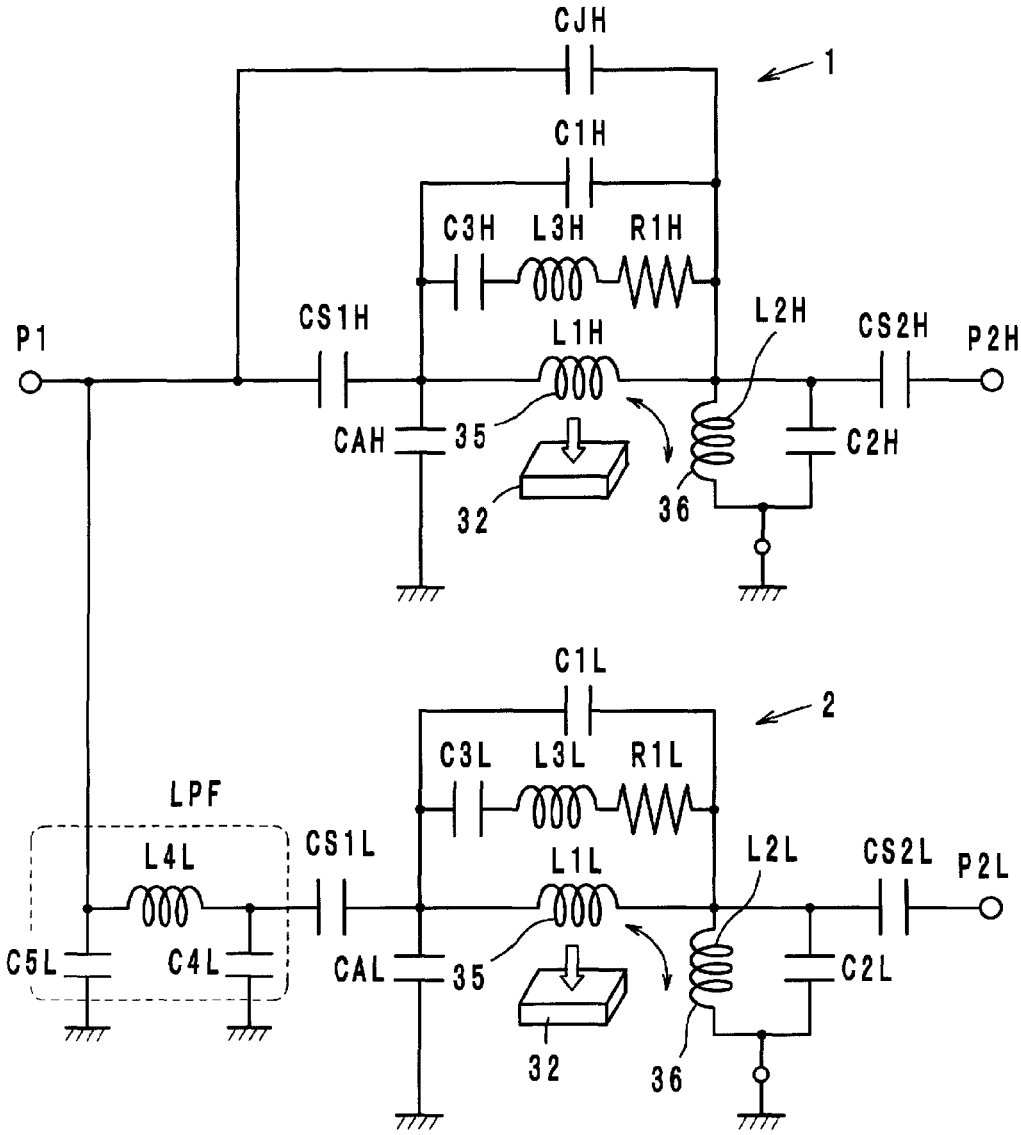
FIG. 11 is an equivalent circuit diagram illustrating a non-reciprocal circuit element according to a fourth preferred embodiment of the present invention.

Referring to FIG. 11, a non-reciprocal circuit element according to a fourth preferred embodiment basically has a circuit structure similar to that of the third preferred embodiment, except the low pass filter LPF provided between the input port P1 and the input portion of the second isolator 2 is preferably a π-type resonant circuit including an inductor L4L and capacitors C4L and C5L. The operational effect of the π-type resonant circuit is similar to that of the L-type low pass filter LPF.

Fifth Preferred Embodiment

FIG. 12

Figure 12:
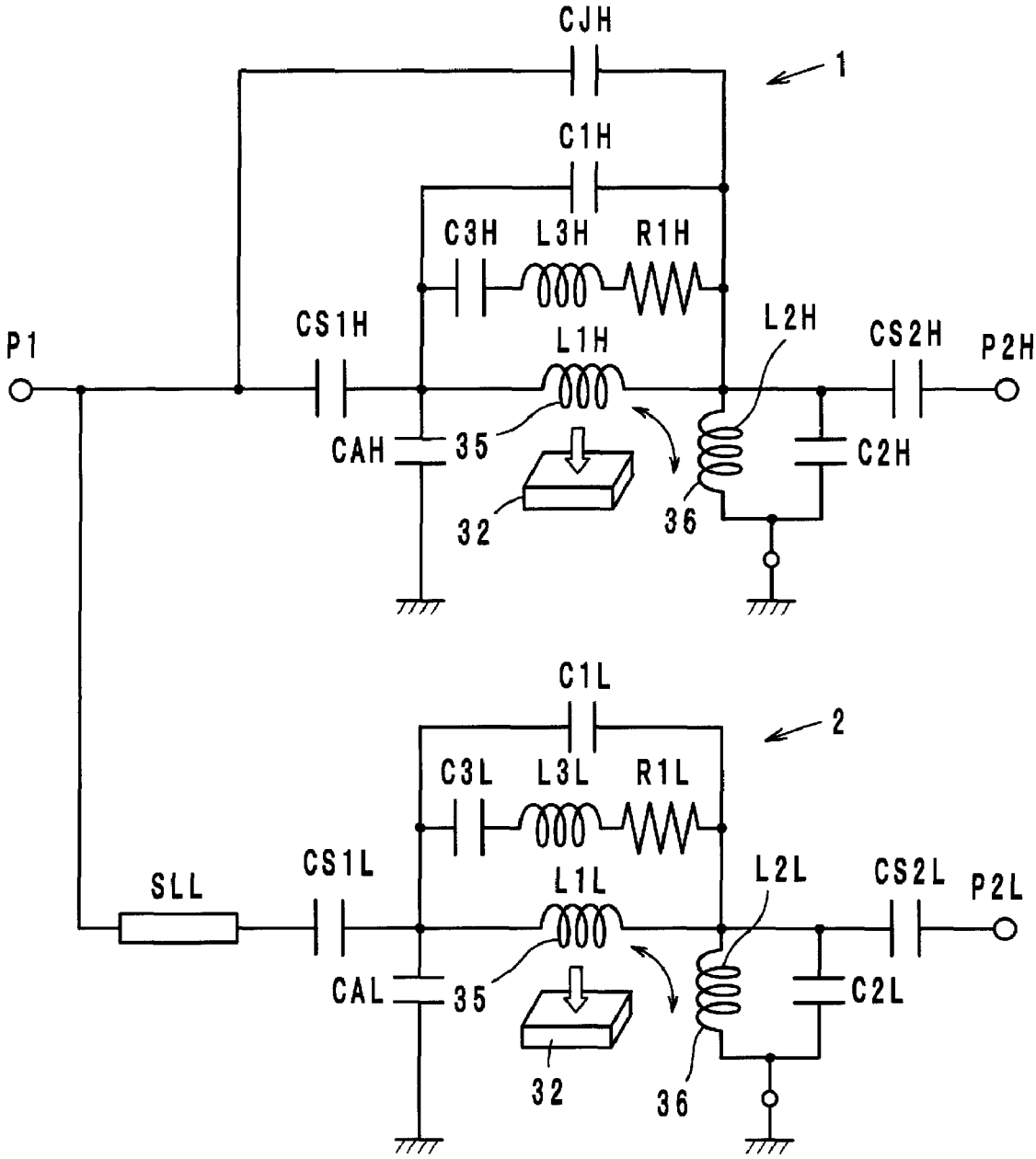
FIG. 12 is an equivalent circuit diagram illustrating a non-reciprocal circuit element according to a fifth preferred embodiment of the present invention.

Referring to FIG. 12, a non-reciprocal circuit element according to a fifth preferred embodiment basically has a circuit structure similar to that of the third preferred embodiment, except a strip line SLL is provided between the input port P1 and the input portion of the second isolator 2. The strip line SLL functions as a low pass filter, and the operational function thereof is similar to that of the low pass filter LPF.

Sixth Preferred Embodiment

Figure 13:
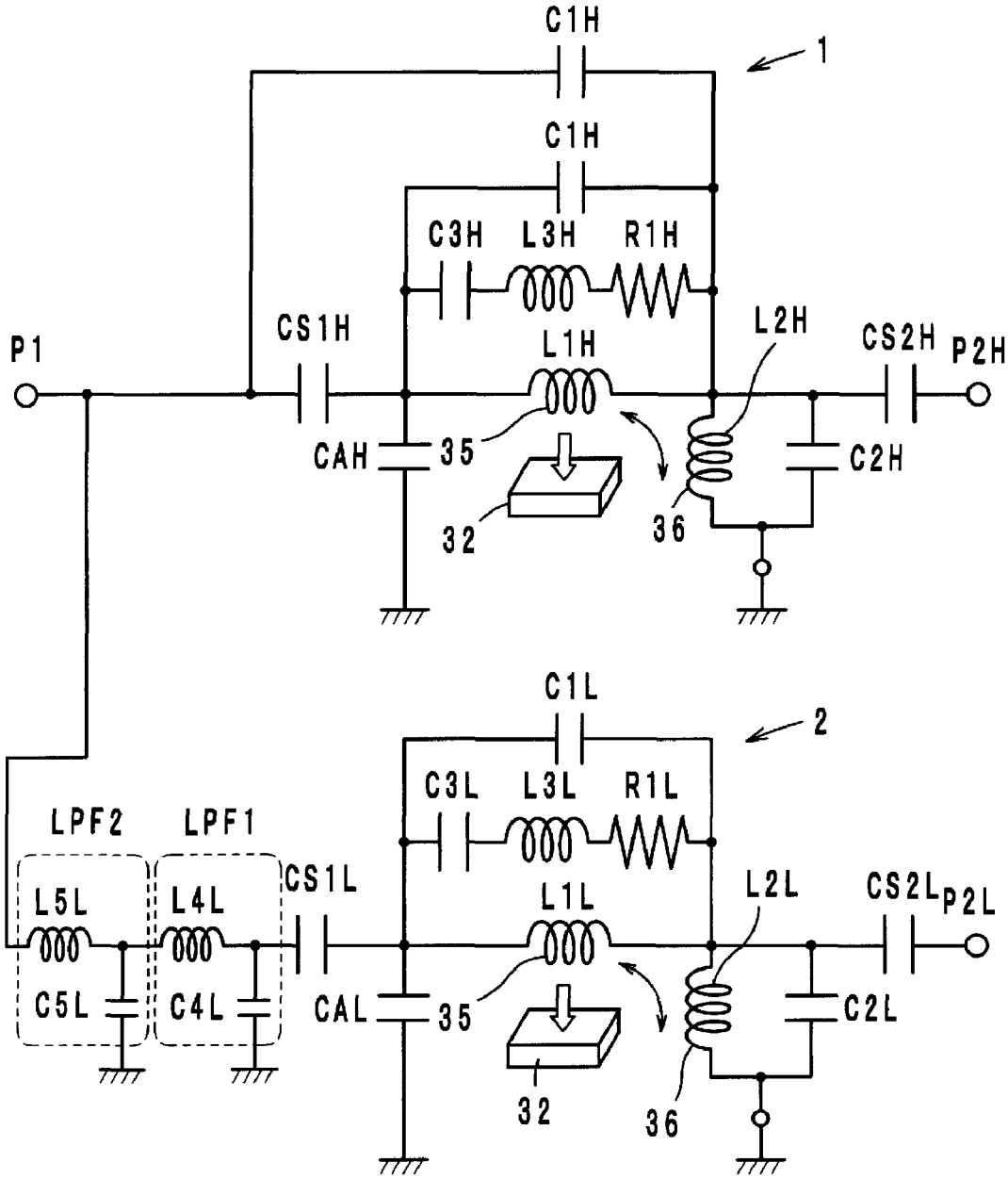
FIG. 13 is an equivalent circuit diagram illustrating a non-reciprocal circuit element according to a sixth preferred embodiment of the present invention.
Figure 14:
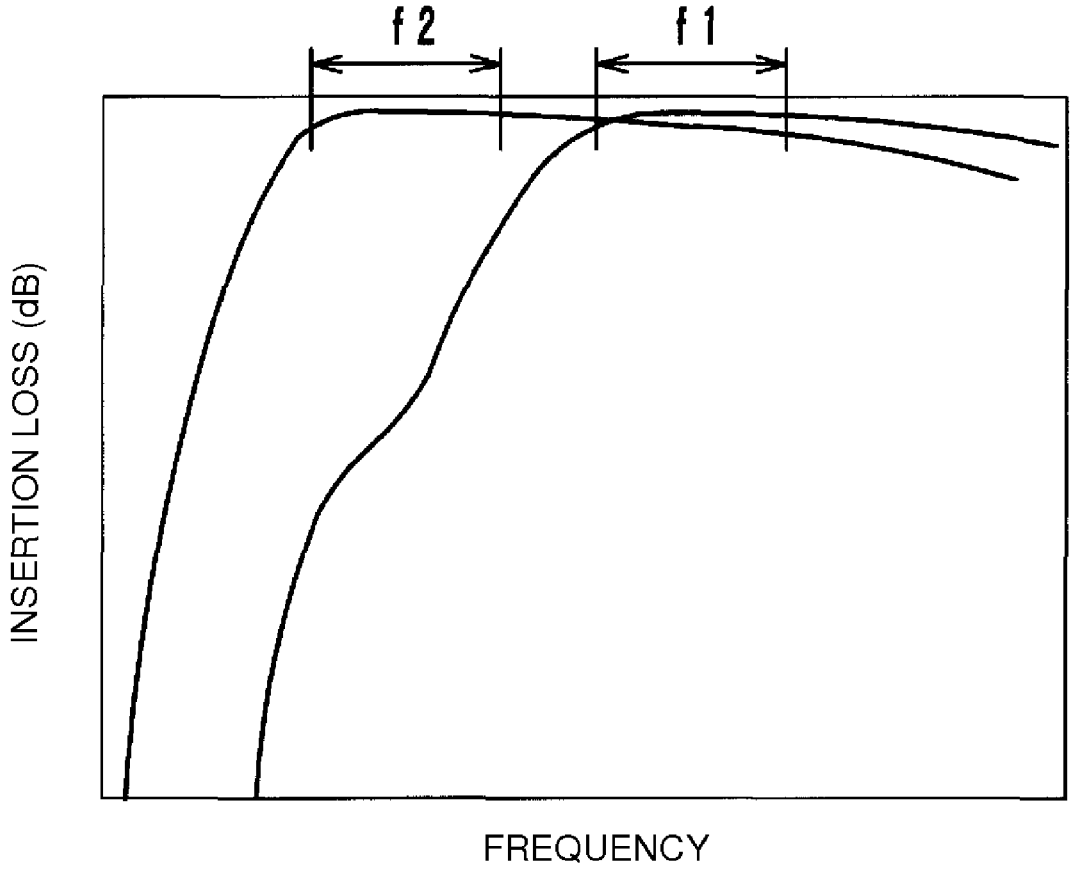
FIG. 14 PRIOR ART
FIG. 14 is a graph showing the insertion loss characteristics in the case where a pair of two-port isolators are combined.

See FIG. 13

Referring to FIG. 13, a non-reciprocal circuit element according to a sixth preferred embodiment basically has a circuit structure similar to that of the third preferred embodiment, except two low pass filters LPF1 and LPF2 are provided between the input port P1 and the input portion of the second isolator 2. The low pass filters LPF1 and LPF2 define L-type resonant circuits including inductors L4L and L5L and capacitors C4L and C5L. The operational effects of the low pass filters LPF1 and LPF2 are similar to that of the low pass filter LPF.

Other Preferred Embodiments

The non-reciprocal circuit element according to the present invention is not limited to the above-described preferred embodiments, and various changes can be made within the scope of the present invention.

In particular, the manner in which components are mounted on the circuit board illustrated in FIG. 2 can be arbitrarily set. In addition, the circuit structure of each isolator and the structure of the ferrite-magnet element may also be arbitrarily determined.

As described above, various preferred embodiments of the present invention can be advantageously applied to non-reciprocal circuit elements, and are advantageous in that operations can be performed in a plurality of frequency bands and increases in the number of components and insertion loss can be prevented.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A non-reciprocal circuit element, comprising:

first and second isolators of a high-pass type, each of the first and second isolators including a permanent magnet, a ferrite body to which a direct-current magnetic field is applied by the permanent magnet, and first and second center electrodes arranged on the ferrite body so as to cross each other in an insulated state; wherein the first isolator has a passing frequency band that is higher than a passing frequency band of the second isolator;

the first and second isolators include input portions that are electrically connected to define a single input port; and a low pass filter is provided between the input port and the input portion of the second isolator.

2. The non-reciprocal circuit element according to claim 1, wherein the low pass filter includes a strip line.

3. The non-reciprocal circuit element according to claim 1, wherein the second center electrode is wound one or more turns around the ferrite body.

4. The non-reciprocal circuit element according to claim 3, wherein, in each of the first and second isolators:

one end of the first center electrode is electrically connected to the input portion and the other end of the first center electrode is electrically connected to an output portion;

one end of the second center electrode is electrically connected to the output portion and the other end of the second center electrode is electrically connected to the ground;

a first matching capacitor is electrically connected between the input portion and the output portion;

a second matching capacitor is electrically connected between the output portion and the ground; and a resistor is electrically connected between the input portion and the output portion.

5. The non-reciprocal circuit element according to claim 1, wherein the low pass filter is of an L-type or a $\pi$-type and includes an inductor and a capacitor.

6. The non-reciprocal circuit element according to claim 5, wherein a number of the low pass filters is two, the two low pass filters being connected to each other.

* * * * *